US007059504B2

(12) United States Patent
Suggs

(10) Patent No.: US 7,059,504 B2
(45) Date of Patent: Jun. 13, 2006

(54) EXTENDABLE AND RETRACTABLE SHOULDER STRAP FOR GOLF BAGS

(75) Inventor: Gregory Suggs, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 421 days.

(21) Appl. No.: 10/614,941

(22) Filed: Jul. 7, 2003

(65) Prior Publication Data

US 2005/0017033 A1 Jan. 27, 2005

(51) Int. Cl.
*A45F 3/02* (2006.01)
*A63B 55/00* (2006.01)

(52) U.S. Cl. ..... 224/631; 224/254; 224/578; 206/315.3

(58) Field of Classification Search ..... 224/631, 224/254, 258, 162, 901.8; 206/315.3
See application file for complete search history.

(56) References Cited

U.S. PATENT DOCUMENTS

| | | | | | |
|---|---|---|---|---|---|
| 1,979,978 | A | * | 11/1934 | Alphonsus | 190/115 |
| 2,437,405 | A | | 3/1948 | Robinson | |
| 3,995,802 | A | * | 12/1976 | Johnston | 294/157 |
| 4,508,202 | A | * | 4/1985 | Siegert et al. | 190/115 |
| 4,658,999 | A | * | 4/1987 | Hilty | 224/609 |
| 4,676,464 | A | | 6/1987 | Reimers | |
| 4,778,136 | A | | 10/1988 | Reimers | |
| 5,072,867 | A | | 12/1991 | Zingale | |
| 5,294,029 | A | * | 3/1994 | Shimura et al. | 224/162 |
| 5,411,194 | A | | 5/1995 | Nagasawa | |
| 5,489,051 | A | * | 2/1996 | Robinson | 224/148.4 |
| 5,529,229 | A | * | 6/1996 | Fier | 224/153 |
| 5,735,398 | A | | 4/1998 | Price | |
| 5,845,833 | A | * | 12/1998 | Murphy | 224/625 |
| 5,881,932 | A | * | 3/1999 | Wadden | 224/153 |
| 5,897,039 | A | * | 4/1999 | Swenke | 224/162 |
| 5,954,255 | A | | 9/1999 | Beebe | |
| 6,053,381 | A | * | 4/2000 | Fahl et al. | 224/153 |
| 6,415,919 | B1 | * | 7/2002 | Keller | 206/315.8 |
| 6,460,747 | B1 | * | 10/2002 | Tuerschmann et al. | 224/645 |
| 2005/0067449 | A1 | * | 3/2005 | Jauvin | 224/254 |

* cited by examiner

*Primary Examiner*—Nathan J. Newhouse
*Assistant Examiner*—Justin M. Larson
(74) *Attorney, Agent, or Firm*—Durrell F. Marquette

(57) ABSTRACT

A golf bag includes a body attached at one end thereof to a top member and at the other end thereof to a bottom member. A shoulder strap has an upper end located near the top member and a lower end located intermediate the top and bottom members. A mechanism urges the shoulder strap into a retracted position but allows movement of the shoulder strap from the retracted position into an extended position. The mechanism may include an elastic cord, an anchor connecting the elastic cord to the bottom member, and a ring connecting the elastic cord to an extension on the upper end of the shoulder strap.

9 Claims, 4 Drawing Sheets

EXTENDABLE AND RETRACTABLE SHOULDER STRAP FOR GOLF BAGS

BACKGROUND OF THE INVENTION

This invention relates generally to golf equipment and, in particular, to an extendable and retractable shoulder strap for golf bags.

When a golf bag has dual shoulder straps, such as disclosed in U.S. Pat. No. 5,954,255 to J. N. Beebe et al, the dual straps are intended to be used in a particular manner to carry the golf bag. In other words, although the dual straps may appear to be identical, one of the straps is specially designed for use on a person's right shoulder and the other strap is specially designed for use on a person's left shoulder. Also, the dual straps must be placed on a person's shoulders in a particular sequence for proper use. In a golf bag with dual straps such as disclosed in the Beebe et al patent, a problem exists because it is sometimes confusing for a person to determine which strap to place on the right shoulder and which strap to place on the left shoulder.

SUMMARY OF THE INVENTION

The present invention provides a golf bag having a generally tubular body attached at one end thereof to a top member and at the other end thereof to a bottom member. A shoulder strap has an upper end located near the top member and a lower end located intermediate the top and bottom members. A mechanism urges the shoulder strap into a retracted position and allows movement of the shoulder strap from the retracted position to an extended position. In the preferred embodiment of the present invention, the mechanism comprises resilient means such as an elastic cord connected to the upper end of the shoulder strap. The upper end of the shoulder strap is returned to the same location adjacent the top member each time the shoulder strap is moved into its retracted position by the mechanism thereby making it easier for a person to locate the shoulder strap and utilize it to lift the golf bag with little or no bending over. The mechanism may also include an anchor connecting the elastic cord to the bottom member, and a ring connecting the elastic cord to an extension on the shoulder strap upper end. When the present invention is used on a golf bag with dual shoulder straps, it is intended that only one of the straps will be equipped with the above-described mechanism so that a person may easily distinguish the straps from each other and then determine which strap is for the right shoulder and which strap is for the left shoulder. This overcomes the problem mentioned above.

DESCRIPTION OF THE PREFERRED EMBODIMENT

Figure 1:
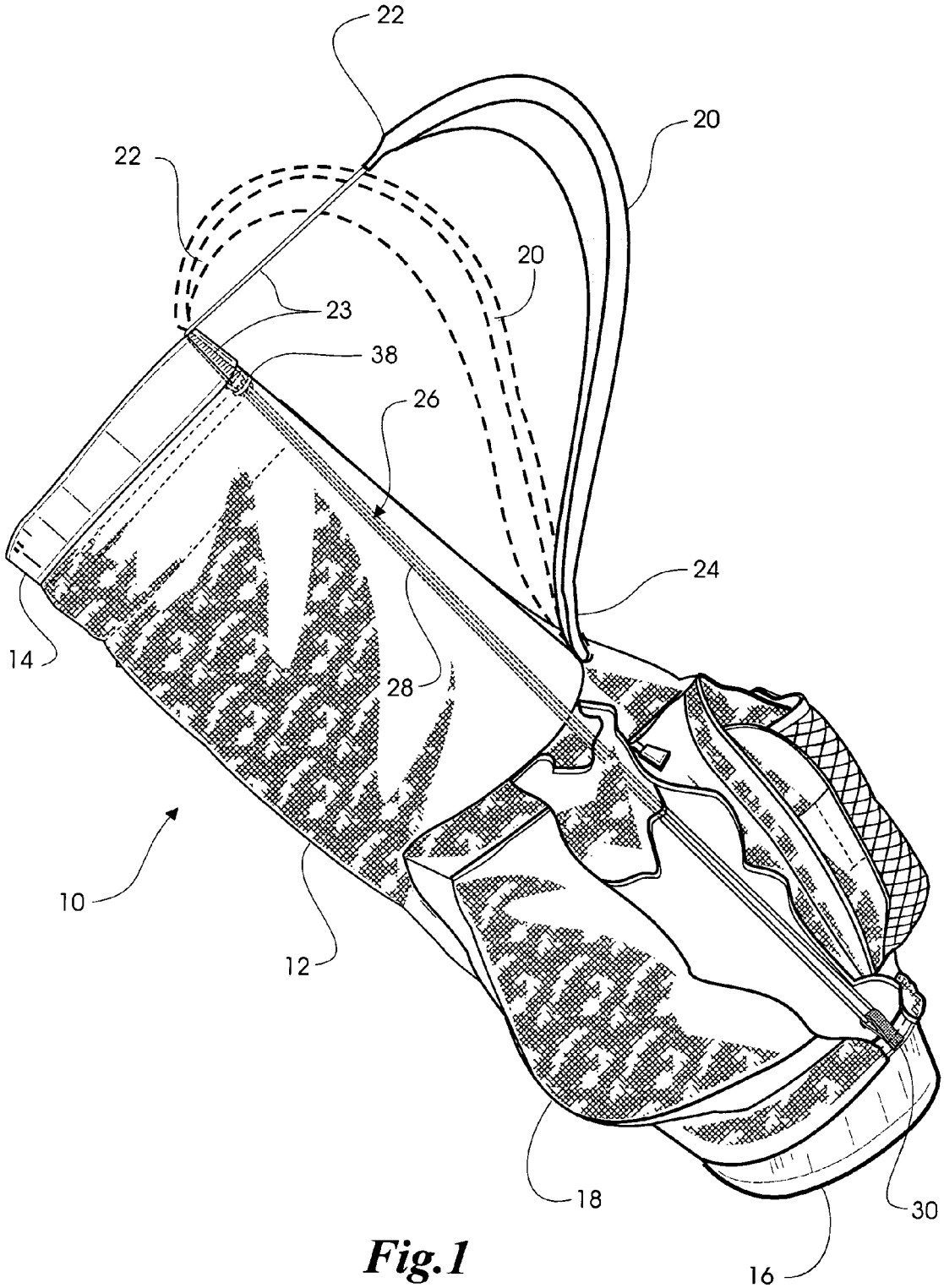
FIG. 1 is a perspective view of a golf bag embodying the preferred embodiment of an extendable and retractable shoulder strap.

Referring to FIG. 1, a golf bag 10 includes a generally tubular body 12 attached at one end thereof to a top member 14 which is open. The other end of the body 12 is attached to a bottom member 16 which is closed. Golf clubs may be inserted and removed through the top member 14 in conventional manner. The golf bag 10 also includes a storage pocket 18 mounted along one side of the body 12.

The top and bottom members 14, 16 are preferably formed of rigid material such as molded plastic while the body 12 is preferably formed of flexible material such as nylon fabric. U.S. Pat. No. D454,249 to G. J. Schmidt, incorporated herein by reference, discloses a golf bag divider top that may be used as the top member 14, and U.S. Pat. No. D372,362 to L. J. Bryant et al, also incorporated herein by reference, discloses a golf bag bottom assembly that may be used as the bottom member 16.

A shoulder strap 20 has an upper end 22 located near the top member 14 and a lower end 24 located intermediate the top and bottom members 14, 16. The shoulder strap 20 may be placed over a person's shoulder and utilized in conventional manner to carry the golf bag 10. If desired, the shoulder strap 20 may be preformed with a permanent curvature that matches a person's shoulder. The upper end 22 of the shoulder strap 20 is connected to a mechanism 26 best shown in FIGS. 2 and 3 which normally urges the shoulder strap 20 into a retracted position shown in broken lines in FIG. 1 and which allows movement of the shoulder strap 20 from that retracted position to an extended position shown in solid lines in FIG. 1. The lower end 24 of the shoulder strap 20 is connected to the body 12 by conventional means such as sewing or riveting.

Figure 2:
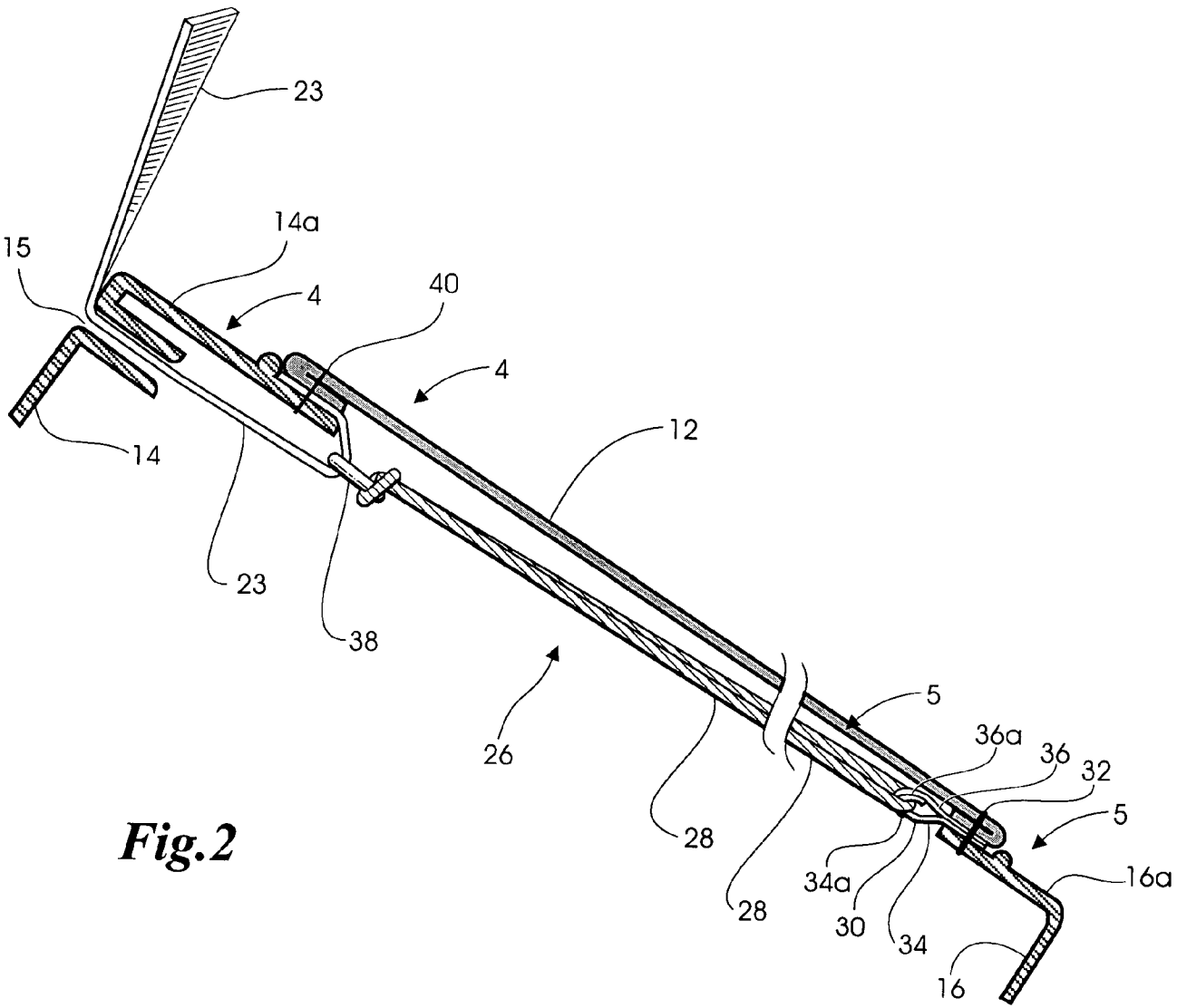
FIG. 2 is an enlarged sectional view of a mechanism for extending and retracting the shoulder strap when the shoulder strap is in an extended position.
Figure 3:
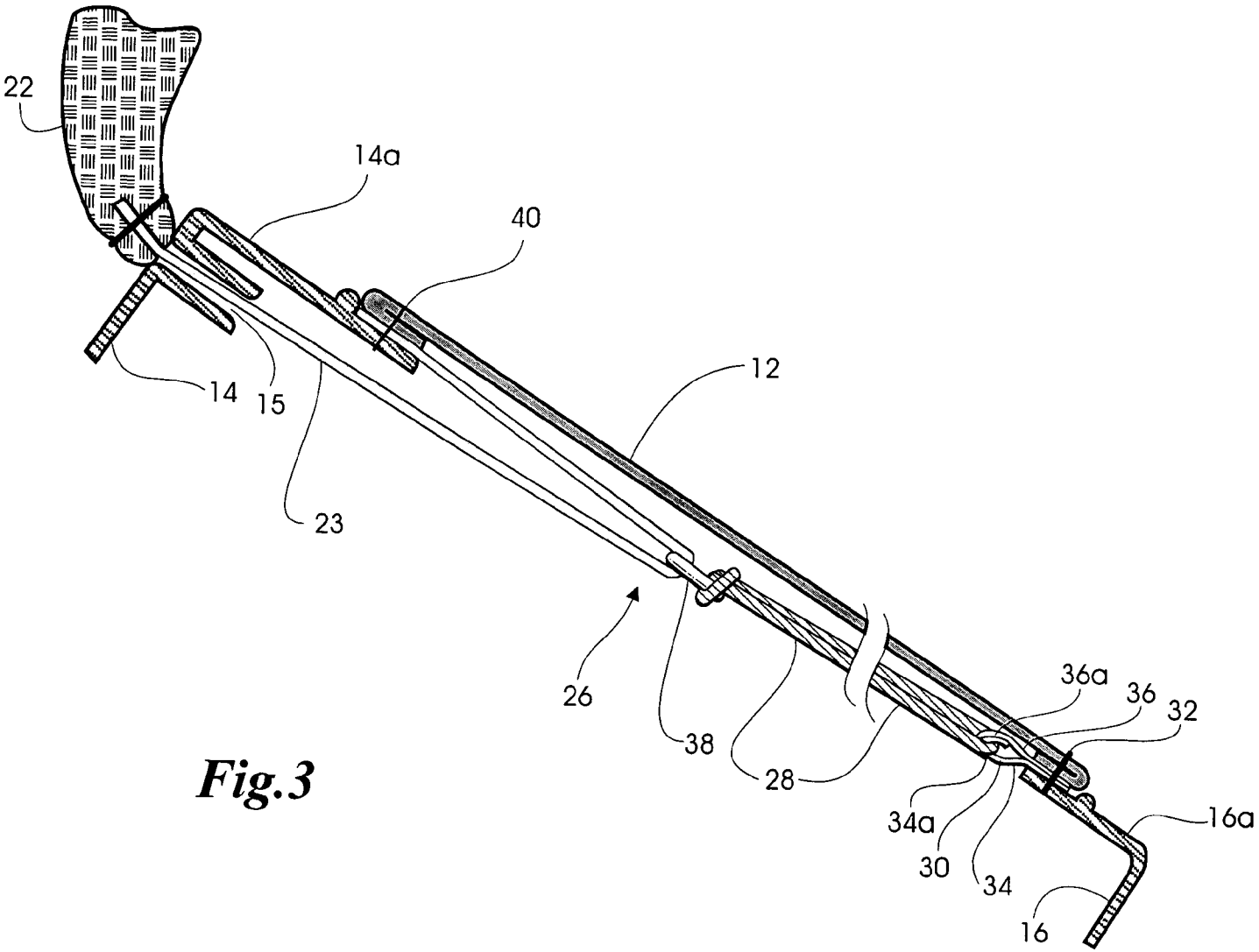
FIG. 3 is an enlarged sectional view of the mechanism shown in FIG. 2 when the shoulder strap is in a retracted position.
Figure 5:
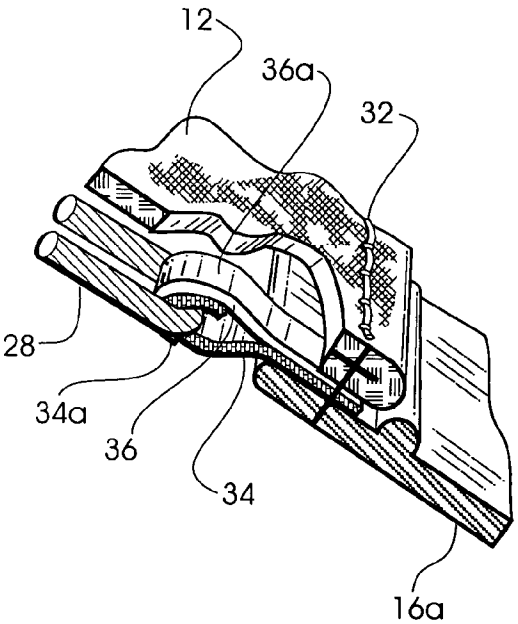
FIGS. 4 and 5 are enlarged sectional views taken along lines 4—4 and 5—5, respectively, in FIG. 2.

Referring to FIGS. 2 and 3, the mechanism 26 includes resilient means such as an elastic cord 28 which passes through an anchor 30 that connects the elastic cord 28 to the bottom member 16. The anchor 30 is secured by stitching 32 to an outer wall 16a of the bottom member 16. As best seen in FIG. 5, the anchor 30 consists of a pair of strips 34, 36 made of fabric such as nylon that have overlapping end portions 34*a*, 36*a*. These end portions 34*a*, 36*a* of strips 34, 36 are releasably held together by utilizing releasable fastener means such as a conventional hook and loop fastener. Therefore, the anchor 30 is releasable so that the elastic cord 28 may be released from the anchor 30 and the mechanism 26 may be deactivated if desired.

Figure 4:
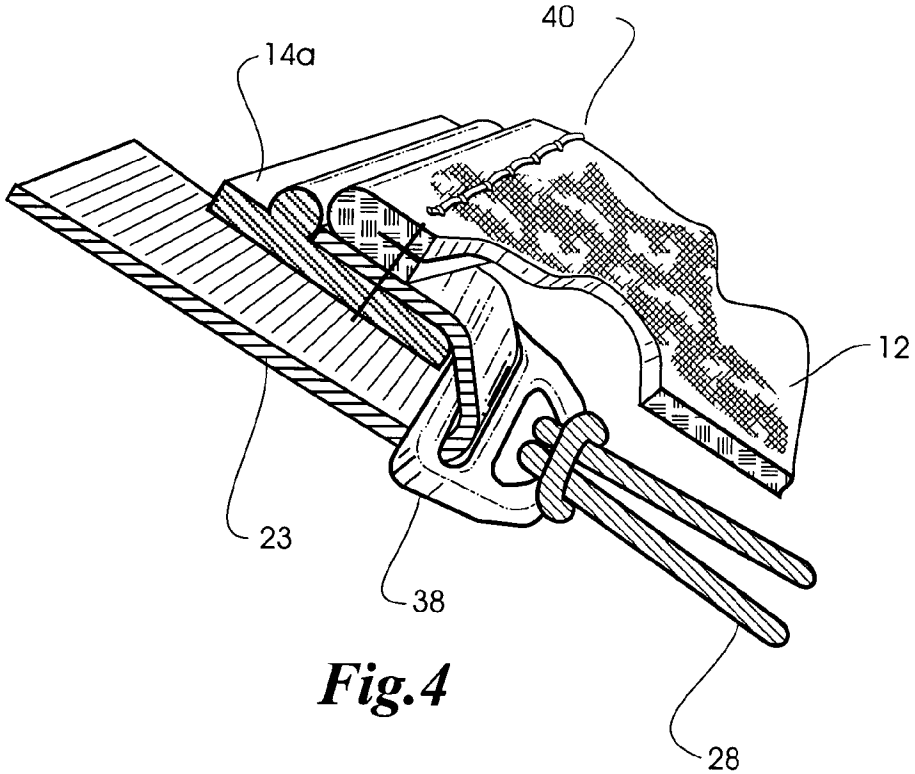

The elastic cord 28 is tied to a ring 38 that is located near the top member 14, as seen in FIG. 2, when the shoulder strap 20 is in its extended position. The ring 38 connects the elastic cord 28 to an extension 23 on the upper end 22 of the shoulder strap 20. The extension 23 extends through the ring 38, as best seen in FIG. 4, and is anchored by stitching 40 to an outer wall 14a of the top member 14. The upper end extension 23 of the shoulder strap 20 passes through an opening 15 formed in the top member 14. When the shoulder strap 20 is in its retracted position, the ring 38 is moved downward (as seen in FIG. 3) toward the bottom member 16 and the upper end 22 of the shoulder strap 20 contacts the top member 14.

It will be understood that the shoulder strap 20 is normally urged into its retracted position shown in broken lines in FIG. 1 by the mechanism 26. When a person utilizes the shoulder strap 20 to lift the golf bag 10, the shoulder strap 20 will be moved into its extended position shown in solid lines in FIG. 1. The movement of the shoulder strap 20 from its retracted position to its extended position is allowed by a stretching action of the elastic cord 28 as illustrated in FIG. 2. When the shoulder strap 20 is released, it is moved into its retracted position by a retracting action of the elastic cord 28 as illustrated in FIG. 3. Each time the shoulder strap 20 is moved into its retracted position by the mechanism 26, the upper end 22 thereof is returned to the same location where it is in contact with the top member 14 adjacent the opening 15. This limits the retracting action of the elastic cord 28 while making it easier for a person to locate the shoulder strap 20 and utilize it for lifting the golf bag 10 with little or no bending over.

In a golf bag (not shown) which has dual shoulder straps instead of the single shoulder strap 20, only one of the dual straps will be equipped with the mechanism 26. This enables a person to easily distinguish the straps from each other and then determine which strap is for the right shoulder and which strap is for the left shoulder.

What is claimed is:

1. A golf bag comprising:

a generally tubular body attached at one end thereof to a top member and at the other end thereof to a bottom member;

a shoulder strap having an upper end located near said top member and having a lower end located intermediate said top and bottom members;

a mechanism for urging said shoulder strap into a retracted position and for allowing movement of said shoulder strap from said retracted position into an extended position;

said mechanism including an elastic cord connected between said bottom member and said upper end of said shoulder strap; said mechanism further including an anchor on said bottom member for connecting said elastic cord to said bottom member; and said anchor being releasable so that said elastic cord may be released from said anchor and said mechanism may be deactivated.

2. The golf hag claim 1, wherein said anchor comprises a pair of strips with overlapping end portions that are releasably held together.

3. The golf bag of claim 2, further comprising releasable fasteners on the overlapping end portions of said strips for releasably fastening said overlapping end portions together.

4. The golf bag of claim 1, wherein said mechanism further comprises a ring for connecting said elastic card to an extension on said shoulder strap upper end.

5. The golf bag of claim 4, wherein said extension on said shoulder strap upper end extends through said ring and is anchored to said top member.

6. The golf bag of claim 5, wherein said top member has an opening formed therein and wherein said extension on said shoulder strap upper end passes through said opening.

7. In a golf bag having a generally tubular body attached at one end thereof to a top member and at the other end thereof to a bottom member, the improvement comprising:

a shoulder strap having an upper end located near said top member and having a lower end located intermediate said top and bottom members;

a mechanism for urging said shoulder strap into a retracted position and for allowing movement of said shoulder strap from said retracted position into an extended position;

said mechanism including an elastic cord connected between said bottom member and said upper end of said shoulder strap; an anchor on said bottom member connecting said elastic cord to said bottom member; and said anchor being releasable so that said elastic cord may be released from said anchor and said mechanism may be deactivated.

8. The improvement of claim 7, farther comprising:

a ring connecting said elastic cord to an extension on said upper end of said shoulder strap.

9. A golf bag comprising:

a generally tubular body attached at one end thereof to a top member and at the other end thereof to a bottom member;

a shoulder strap having an upper end located near said top member and having a lower end located intermediate said top and bottom members;

a mechanism for urging said shoulder strap into a refracted position and for allowing movement of said shoulder strap from said retracted position into an extended position;

said mechanism including an elastic cord connected between said bottom member and said upper end of said shoulder strap, an anchor on said bottom member connecting said elastic cord to said bottom member, and a ring connecting said elastic cord to an extension on said shoulder swap upper end;

said extension of said shoulder strap upper end extending through said ring and being anchored to said top member;

said top member having an opening formed therein and said extension on said shoulder strap upper end passing through said opening; and said anchor being releasable so that said elastic cord may be released from said anchor and said mechanism may be deactivated.

* * * * *